US006776285B2

(12) United States Patent
Shibata

(10) Patent No.: US 6,776,285 B2
(45) Date of Patent: Aug. 17, 2004

(54) BLISTER PACK

(75) Inventor: Yukihiko Shibata, Nagoya (JP)

(73) Assignee: Daiwa Gravure Co., Ltd., Aichi (JP)

( * ) Notice: Subject to any disclaimer, the term of this patent is extended or adjusted under 35 U.S.C. 154(b) by 60 days.

(21) Appl. No.: 10/057,174

(22) Filed: Jan. 25, 2002

(65) Prior Publication Data

US 2002/0100709 A1 Aug. 1, 2002

(30) Foreign Application Priority Data

Jan. 30, 2001 (JP) ..... 2001-020859

(51) Int. Cl.[7] ..... B65D 83/04
(52) U.S. Cl. ..... 206/469; 206/531
(58) Field of Search ..... 206/467, 469, 206/531, 532, 534, 538, 539

(56) References Cited

U.S. PATENT DOCUMENTS 3,872,970 A * 3/1975 Edison ..... 206/532
4,243,144 A * 1/1981 Margulies ..... 206/532
4,294,361 A * 10/1981 Margulies et al. ..... 206/532
5,325,968 A * 7/1994 Sowden ..... 206/532
5,360,116 A 11/1994 Schmiletzky ..... 206/531
5,393,032 A * 2/1995 Cederroth ..... 206/532
5,833,071 A * 11/1998 Ray ..... 206/532
6,161,699 A * 12/2000 Gartland ..... 206/531

FOREIGN PATENT DOCUMENTS

DE 1288979 2/1969
DE 4402038 7/1994

* cited by examiner

*Primary Examiner*—Jim Foster
(74) *Attorney, Agent, or Firm*—Fildes & Outland, P.C.

(57) ABSTRACT

An object of the present invention is to facilitate separate waste disposal of blister packs by consumers. To achieve this object, a blister pack has been provided, which comprises a sheet-like thermoformed body having a number of protrusions extruded from a surface of the body; and a laminated film made from a synthetic resinous material, which closes openings of recesses on a reverse face of the thermoformed body after to-be-packaged matters have been placed in the recesses, each recess forming an interior of each protrusion, wherein the laminated film is bonded to the thermoformed body with a small bonding strength to be capable of peeling, and a cut is formed in a position surrounding the opening of each recess such that the cut penetrates the laminated film in its thickness direction from its reverse face but does not penetrate the body in its thickness direction.

6 Claims, 5 Drawing Sheets

BLISTER PACK

FIELD OF THE INVENTION

The present invention relates to a blister pack for packaging, for example, medical tablets and granular confectionery (e.g., lemon pop powder, chocolate and the like).

BACKGROUND OF THE INVENTION

Heretofore, generally known as a blister pack for packaging medical tablets, for example, is a thermally formed sheet-like pack made from a transparent synthetic resinous material, with a number of protrusions formed on a surface of the pack. Medical tablets, for example, are placed in recesses each forming an interior of each protrusion, and in this state, an aluminum foil is laminated over an entire reverse face of the sheet-like thermoformed pack to close openings of the recesses.

To take out a tablet packaged in this conventional blister pack, a protrusion is pushed toward the reverse side of the pack with a finger, and the aluminum foil closing the opening of the recess is broken by a thrusting force of the tablet being pushed, thereby allowing the recess to open and the tablet to be taken out from the opening of the recess.

According to the conventional blister pack stated above, the aluminum foil is used to be broken by the thrusting force of the tablet being pushed to allow the recess to open. However, after the tablets have all been taken out, the aluminum foil remains on the reverse face of the sheet-like thermoformed blister pack, adhering at least to other portions than the recess portions on the reverse face of the blister pack. This poses a problem that it is very hard for consumers, in separate waste disposal, to separate between the synthetic resinous material forming the sheet-like blister pack and the aluminum foil used to cover the reverse face of the pack.

SUMMARY OF THE INVENTION

It is an object of the present invention, therefore, to solve the above-mentioned problem of the prior art. According to the present invention, consumers can easily carry out separate waste disposal because an aluminum foil is not used but a film made from a synthetic resinous material is used for a reverse face of a sheet-like thermoformed pack.

Main points for achieving the object of the present invention are mentioned below.

1. To provide a blister pack comprising: a sheet-like thermoformed body having a number of protrusions extruded from a surface of the sheet-like thermoformed body; and a laminated film made from a synthetic resinous material, which closes openings of recesses on a reverse face of the body after to-be-packaged matters have been placed in the recesses, each recess forming an interior of each protrusion, wherein the laminated film is peelably bonded to the sheet-like thermoformed body with a small bonding strength and a cut is formed in a position surrounding the opening of each recess such that the cut penetrates the laminated film in its thickness direction from its reverse face but does not penetrate the sheet-like thermoformed body in its thickness direction.

2. To provide a blister pack mentioned above under 1, wherein the bonding strength of the laminated film to the sheet-like thermoformed body is 1.0 N/cm to 13.0 N/cm in heat-sealing strength.

3. To provide a blister pack mentioned above under 1, wherein the cut is of a circular shape.

4. To provide a blister pack mentioned above under 1, wherein the cut is of a U shape.

5. To provide a blister pack mentioned above under 1, wherein the cut is of a circular shape having a partly discontinuous outer periphery.

According to the foregoing construction, when the protrusion is pushed by a finger to press the matter packaged in the recess toward a portion of the laminated film which is surrounded by the cut, the pushing force causes peeling at a bonded joint between the periphery of the portion of the laminated film surrounded by the cut and a portion adjacent to the outer periphery of the opening on the sheet-like formed body. As a result, the opening is uncovered and the packaged matter can be taken out from the recess. In addition, the film to be bonded to the reverse face of the sheet-like thermoformed body is not an aluminum foil but a laminated film made from a synthetic resinous material, so that separate waste disposal by consumers can be carried out with ease.

DESCRIPTION OF PREFERRED EXAMPLES

Figure 1:
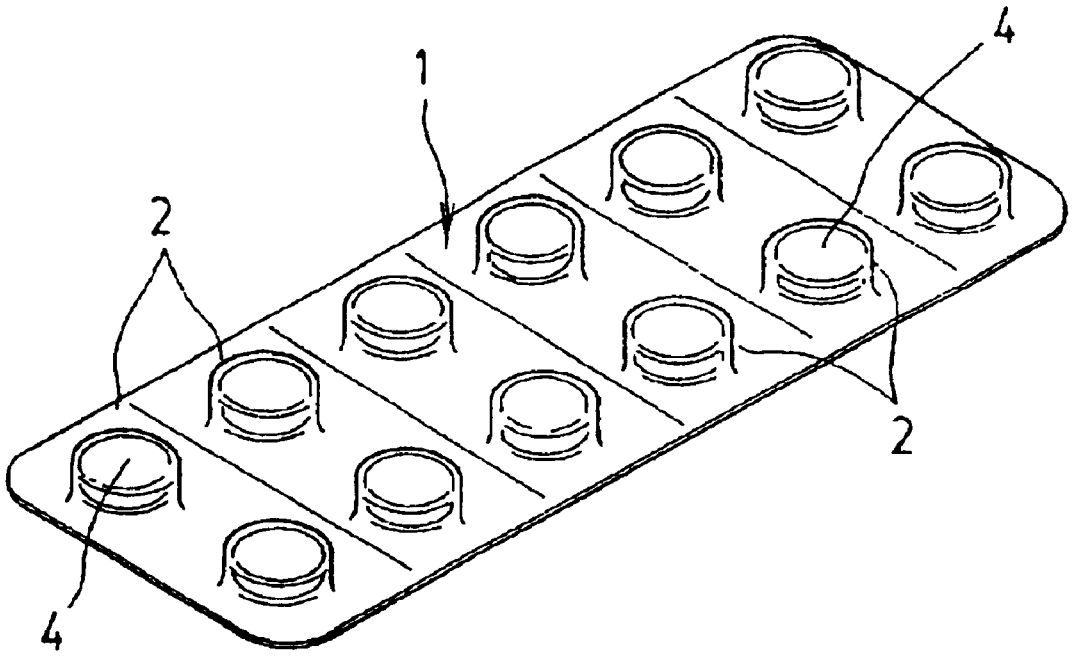
FIG. 1 is a perspective view of a blister pack according to a first embodiment of the present invention.
Figure 2:
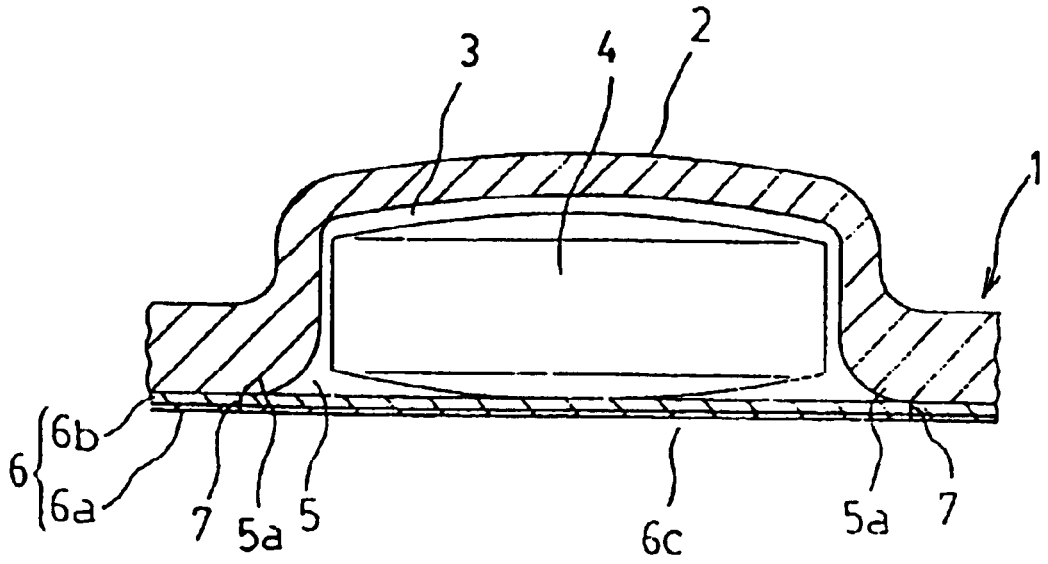
FIG. 2 is an enlarged cross-sectional view of an essential part of the blister pack.
Figure 3:
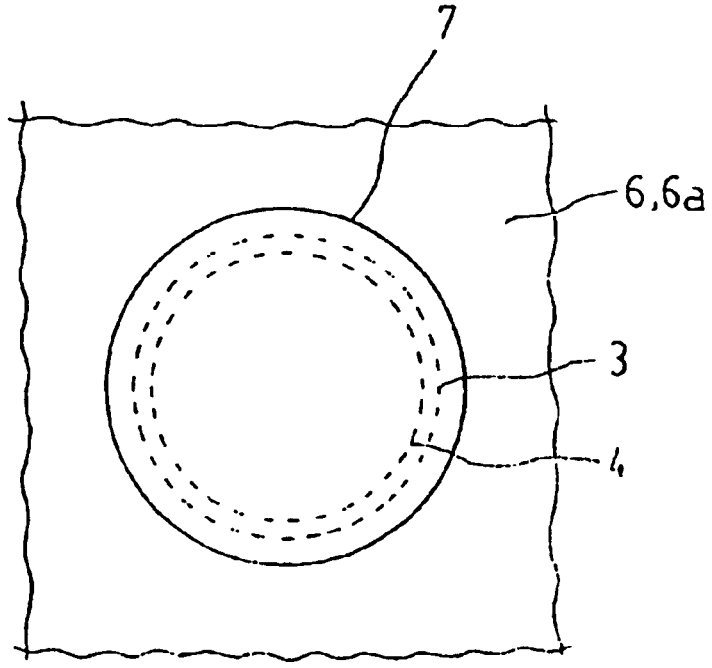
FIG. 3 is an enlarged reverse side view of the essential part of the blister pack.
Figure 4:
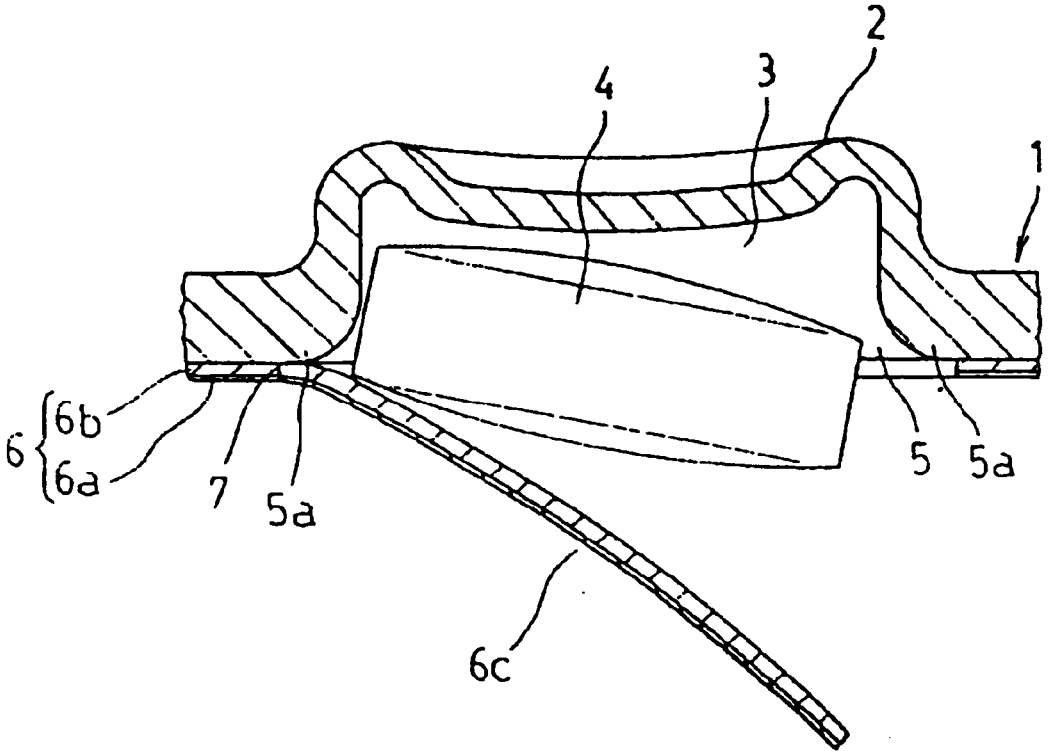
FIG. 4 is an enlarged cross-sectional view of the essential part illustrating a state in which a tablet is being taken out of the blister pack.

FIGS. 1 to 4 illustrate the first example of the present invention.

In FIGS. 1 to 4, 1 designates a sheet-like body thermoformed using a transparent synthetic resinous material, for example, polypropylene. The sheet-like thermoformed body comprises on its surface a number of protrusions 2 each having a thickness of about 90 $\mu$m, and a flat portion other than the protrusions 2 and having a thickness of about 200 $\mu$m. After tablets 4 having a circular peripheral shape are placed in recesses 3 each forming an interior of each protrusion 2, the sheet-like body 1 is heat sealed with a synthetic-resin laminated film 6 over its entire reverse face to close openings 5 of the recesses 3. The laminated film 6 comprises a transparent vapor-deposited polyethylene terephthalate film layer 6*a* having a thickness of about 12 $\mu$m, and a transparent film layer 6*b* having a thickness of about 30 $\mu$m and composed of a blend material consisting of an ethylene/vinyl acetate copolymer and an olefin resin. The film layer 6*b* is bonded to the film layer 6*a* by dry laminating with a large bonding strength of 2.0 N/cm or more in peel strength. The laminated film 6 is layered on and heat sealed to the sheet-like thermobonded body 1 to be capable of interfacial peeling at the heal sealed face, in such a manner that the film layer 6*b* faces the reverse face of the sheet-like thermoformed body 1. Specifically, the film layer 6*b* and the sheet-like thermoformed body 1 are bonded together with a small bonding strength of about 1.0 N/cm to 13.0 N/cm in heat-sealing strength. The purpose of including the transparent vapor-deposited polyethylene terephthalate film layer 6*a* in the laminated film 6 is to prevent moisture penetration into the recesses 3 and to provide a gas-barrier effect. The sheet-like thermoformed body 1, which is made from polypropylene and has a large thickness, can prevent moisture penetration into each recesses 3. If the sheet-like thermoformed body 1 is required to have a gas-barrier property, a film layer composed of a material with a gas-barrier effect may be included in the sheet-like body 1.

In the above-described state in which the laminated film 6 is bonded to the sheet-like thermoformed body 1, a circular cut 7 is formed in a position surrounding each of the openings 5 such that the cut penetrate the laminated film 6 from the reverse face thereof in the thickness direction thereof but does not penetrate the sheet-like thermoformed body 1 in the thickness direction thereof. Although the cut 7 is formed in the laminated film 6, the periphery of a film layer 6*b* of a laminated film 6*c* surrounded by the cut 7 is bonded to a portion 5*a* adjacent to the outer periphery of the opening 5 of the sheet-like thermoformed body 1. Therefore, a portion of the laminated film 6*c* surrounded by the cut 7 does not come off but keeps the openings 5 of the sheet-like thermoformed body 1 in a closed state unless an external force, such as a pushing force, is given to the portion of the laminated film 6*c* surrounded by the cut 7.

When a tablet 4 is taken out from the recess 3 of the above-described blister pack, the protrusion 2 of the sheet-like thermoformed body 1 is pushed by a finger so as to press the tablet 4 present in the recess 3 toward the portion of the laminated film 6*c* surrounded by the cut 7. The pushing force causes peeling at the bonded junction between the periphery of the portion of the laminated film 6*c* surrounded by the cut 7 and the portion 5*a* adjacent to the outer periphery of the opening 5 of the sheet-like thermoformed body 1. As a result, the opening 5 is uncovered and the tablet 4 can be taken out from the recess 3.

Figure 5:
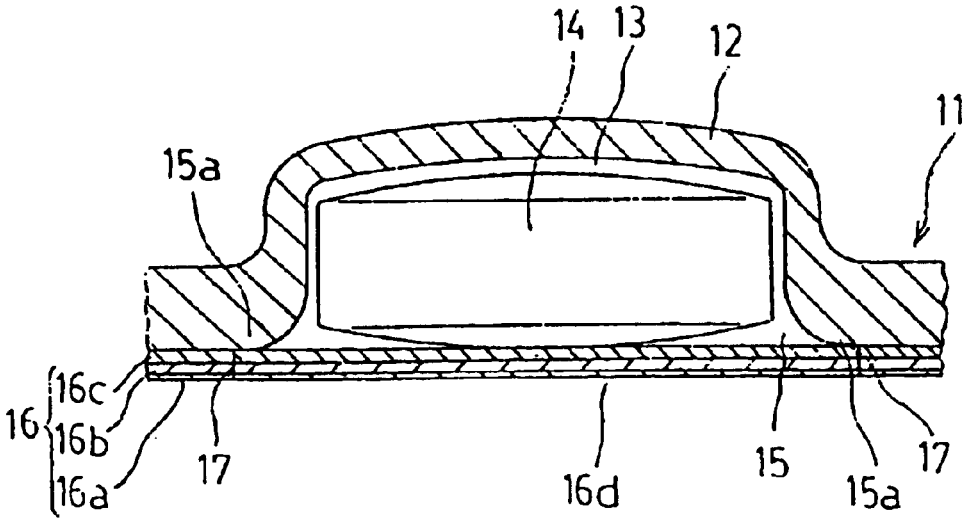
FIG. 5 is an enlarged cross-sectional view of an essential part of a blister pack according to a second embodiment of the present invention.
Figure 6:
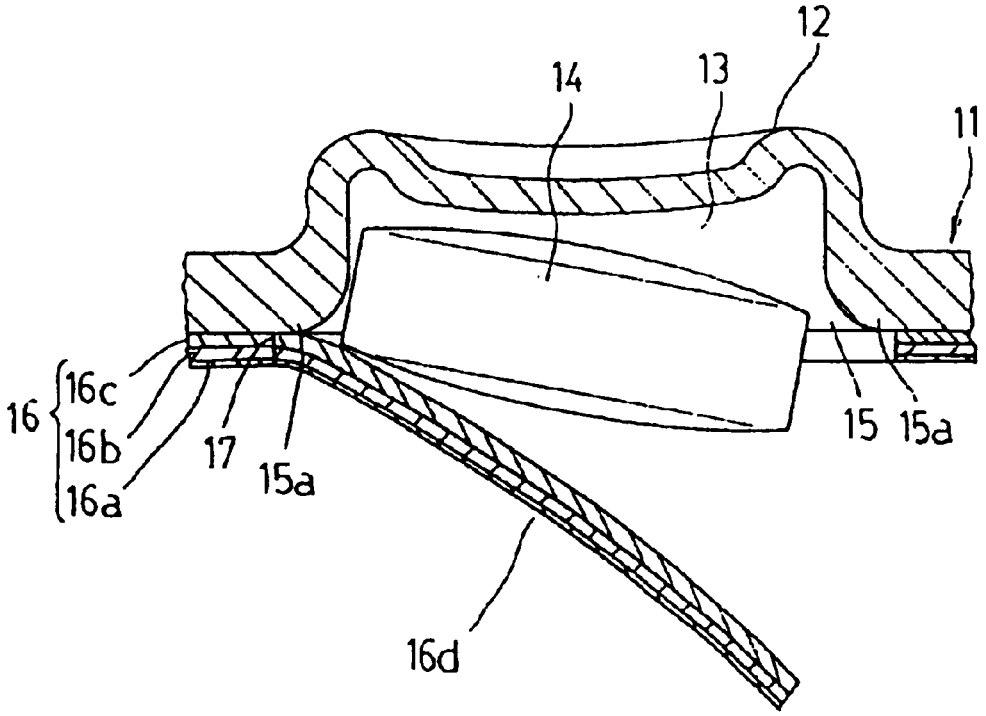
FIG. 6 is an enlarged cross-sectional view of the essential part illustrating a state in which a tablet is being taken out of the blister pack.

FIGS. 5 and 6 illustrate the second example of the present invention.

In FIGS. 5 and 6, 11 is a sheet-like body thermoformed using a transparent synthetic resinous material, for example, polypropylene. The sheet-like thermoformed body comprises on its surface a number of protrusions 12 each having a thickness of about 90 $\mu$m, and a flat portion other than the protrusions 12 and having a thickness of about 200 $\mu$m. After tablet 14 having a circular outer periphery are placed in recesses 13 each forming an interior of each protrusion 12, the sheet-like body 11 is heat sealed with a synthetic-resin laminated film 16 over its entire reverse face to close openings 15 of the recesses 13. The laminated film 16 comprises a transparent vapor-deposited polyethylene terephthalate film layer 16*a* having a thickness of about 12 $\mu$m, a polyethylene film layer 16*b* having a thickness of about 30 $\mu$m and bonded to the film layer 16*a* by dry lamination, and a film layer 16*c* having a thickness of about 30 $\mu$m which is composed of a blend material consisting of a transparent ethylene/vinyl acetate copolymer and an olefin resin, and is laminated to the film layer 16*b* by coextrusion. And, as the film layer 16*c* is adhered to the entire reverse face of the sheet-like thermoformed body 11, the openings 15 of the recesses 13 on the reverse face of the sheet-like thermoformed body 11, in each of which the tablet 14 is placed in advance, are closed. Besides, the film layer 16*a* and the film layer 16*b*, and the film layer 16*b* and the film layer 16*c* are each bonded together with a large bonding strength of 2.0 N/cm or more in peel strength, whereas the film layer 16*c* is bonded to the sheet-like thermoformed body 11 with a small bonding strength of about 1.0 N/cm to 13.0 N/cm in heat-sealing strength so that interfacial peeling therebetween is possible.

In the above-described state in which the laminated film 16 is bonded to the sheet-like thermoformed body 11, a circular cut 17 is formed in a position surrounding each of the openings 15 such that the cut penetrate the laminated film 16 from the reverse face thereof in the thickness direction thereof but does not penetrate the sheet-like thermoformed body 11 in the thickness direction thereof. Although the cut 17 is formed in the laminated film 16, the periphery of a portion of the laminated film 16*d* surrounded by the cut 17, more specifically the periphery of the film layer 16*c* surrounded by the cut 17, is bonded to a portion 15*a* adjacent to the outer periphery of the opening 15 of the sheet-like thermoformed body 11. Therefore, the portion of the laminated film 16*d* surrounded by the cut 17 does not come off and keeps the openings 15 of the sheet-like thermoformed body 11 in a closed state unless an external force, such as a pushing force, is given to the portion of the laminated film 16*d* surrounded by the cut 17.

When a tablet 14 is taken out from the recess 13 of the above-described blister pack, the protrusion 12 of the sheet-like thermoformed body 11 is pushed by a finger so as to press the tablet 14 present in the recess 13 toward the portion of the laminated film 16*d* surrounded by the cut 17. The pushing force causes peeling at the bonded junction between the periphery of the film layer 16*c* of the laminated film 16*d* surrounded by the cut 17 and the portion 15*a* adjacent to the outer periphery of the opening 15 of the sheet-like thermoformed body 11. As a result, the opening 15 is uncovered and the tablet 14 can be taken out from the recess 13.

Figure 7A:
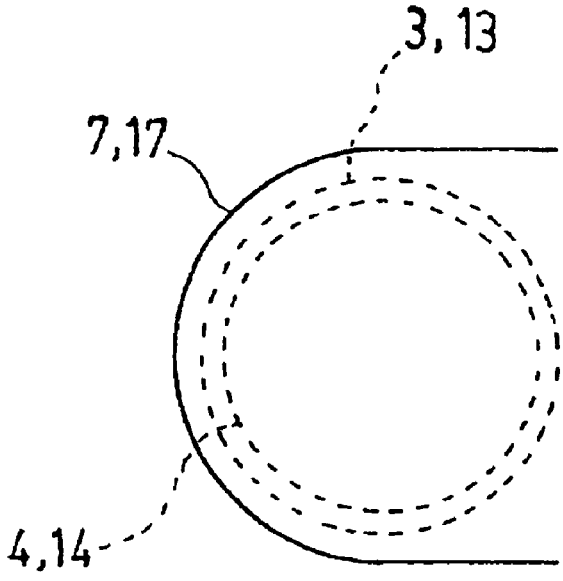
FIGS. 7(*a*) and (*b*) illustrates variations of a cut formed in a laminated film.
Figure 7B:
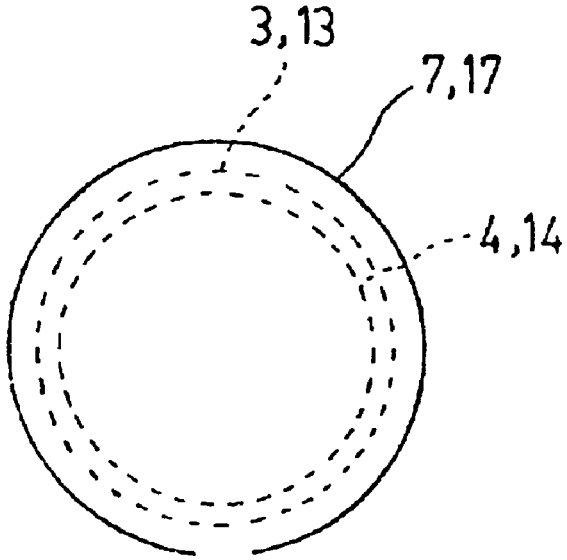

In the two embodiments described above, the cut 7 and cut 17 are of a circular shape. But, the shape may be a U shape as shown in FIG. 7*a* or may be a circle of which outer periphery is partly discontinuous as shown in FIG. 7*b*. In addition, if and when the shape of the tablet is not a circle, the shape of the cut may be determined in accordance with the shape of the tablet. Further, the matter to be placed in the blister pack may be a granular confectionery, such as lemon pop powder, chocolate and the like, besides the above-mentioned tablet.

Further, although the sheet-like thermoformed body 1, 11 and the laminated film 6, 16 are bonded to each other by heat sealing to be capable of interfacial peeling therebetween in the above-mentioned embodiments, they may be bonded to each other to be capable of cohesive peeling or to be capable of interlayer peeling, by selecting appropriate materials for the sheet-like thermoformed body 1, 11 and the laminated film 6, 16 to be bonded to this sheet-like thermoformed body 1, 11.

Furthermore, a paper sheet may be present in the laminated film 6, 16 as a sandwiched interlayer.

What is claimed is:

1. A blister pack comprising:

a thermoformed sheet-like body having a number of protrusions extruded from a surface of the body; and a laminated film made from a synthetic resinous material, which closes openings of recesses on a reverse face of the sheet-like thermoformed body after to-be-packaged matters have been placed in the recesses, each recess forming an interior of each protrusion, wherein said laminated film which closes the openings comprises a polyethylene terephthalate layer, and a film layer composed of a blend material consisting of an ethylene/vinyl acetate copolymer resin and an olefin resin and laminated to said polyethylene terephthalate layer, said laminated film is layered on said thermoformed sheet-like body such that the film layer composed of the blend material faces the reverse face of said thermoformed sheet-like body, and bonded to the sheet-like thermoformed body with a small bonding strength to be capable of peeling, and a cut is formed in a position surrounding the opening of each recess such that the cut penetrates the laminated film from a face of the laminated film opposite the sheet-like thermoformed body in a thickness direction thereof but does not penetrate the sheet-like thermoformed body in the thickness direction thereof.

2. A blister pack according to claim 1, wherein the bonding strength of the laminated film to the sheet-like thermoformed body is 1.0 N/cm to 13.0 N/cm in heat-sealing strength.

3. A blister pack according to claim 1, wherein the cut is of a circular shape.

4. A blister pack according to claim 1, wherein the cut is of a U shape.

5. A blister pack according to claim 1, wherein the cut is of a circular shape having a partly discontinuous outer periphery.

6. The blister pack according to claim 1, wherein said laminated film comprises a polyethylene film layer bonded to said polyethylene terephthalate film layer by dry lamination, and said film layer composed of a blend material consisting of an ethylene/vinyl acetate copolymer resin and an olefin resin is laminated to the polyethylene film layer.

* * * * *